United States Patent [19]

Bremigan

[11] Patent Number: 5,044,464

[45] Date of Patent: Sep. 3, 1991

[54] ACTIVE ACOUSTIC ATTENUATION MIXING CHAMBER

[75] Inventor: Cary D. Bremigan, Madison, Wis.

[73] Assignee: Nelson Industries, Inc., Stoughton, Wis.

[21] Appl. No.: 468,590

[22] Filed: Jan. 23, 1990

[51] Int. Cl.[5] ..... F01N 1/06

[52] U.S. Cl. ..... 181/206; 381/71; 60/312

[58] Field of Search ..... 181/206; 381/71; 60/312

[56] References Cited

U.S. PATENT DOCUMENTS

| | | | |
|---|---|---|---|
| 4,487,289 | 12/1984 | Kicinski et al. | 181/252 |
| 4,527,282 | 7/1985 | Chaplin et al. | 381/71 |
| 4,665,549 | 5/1987 | Eriksson et al. | 381/71 |
| 4,677,676 | 6/1987 | Eriksson | 381/71 |
| 4,677,677 | 6/1987 | Eriksson | 381/71 |
| 4,736,431 | 4/1988 | Allie et al. | 381/71 |
| 4,815,139 | 3/1989 | Eriksson et al. | 381/71 |
| 4,837,834 | 6/1989 | Allie | 381/71 |

OTHER PUBLICATIONS

"The Cancellation of Repetitive Noise and Vibration", Barrie Chaplin, Inter-Noise 80, Miami, Fla., Dec. 8-10, 1980.

*Primary Examiner*—Brian W. Brown

*Attorney, Agent, or Firm*—Andrus, Sceales, Starke & Sawall

[57] ABSTRACT

Active acoustic attenuation apparatus is provided for cancellation of noise from an exhaust pipe (12). A chamber (50) has an input (70) receiving exhaust from the exhaust pipe and directing the exhaust along a flowpath (76) to a chamber output (74). Speakers (88, 90) are transversely spaced and offset from the flowpath and introduce sound into the chamber at a space (56) having a transverse area at least as large as each speaker, to minimize acoustic loading of the speakers and to protect the speakers from the heat of hot exhaust for automotive applications, including electronic mufflers.

34 Claims, 3 Drawing Sheets

ACTIVE ACOUSTIC ATTENUATION MIXING CHAMBER

BACKGROUND AND SUMMARY

The invention relates to active acoustic attenuation systems.

Active acoustic attenuation is accomplished by sound wave interference. Undesirable noise is attenuated by the introduction of cancelling sound which ideally is a mirror image of the undesirable sound, to thus cancel same.

The present invention provides a chamber for mixing the cancelling sound with the undesirable sound. The invention particularly arose during development efforts directed toward providing an electronic muffler for a motor vehicle exhaust by means of active acoustic attenuation, though the invention is not limited thereto.

DETAILED DESCRIPTION

Prior Attempts

Figure 1:
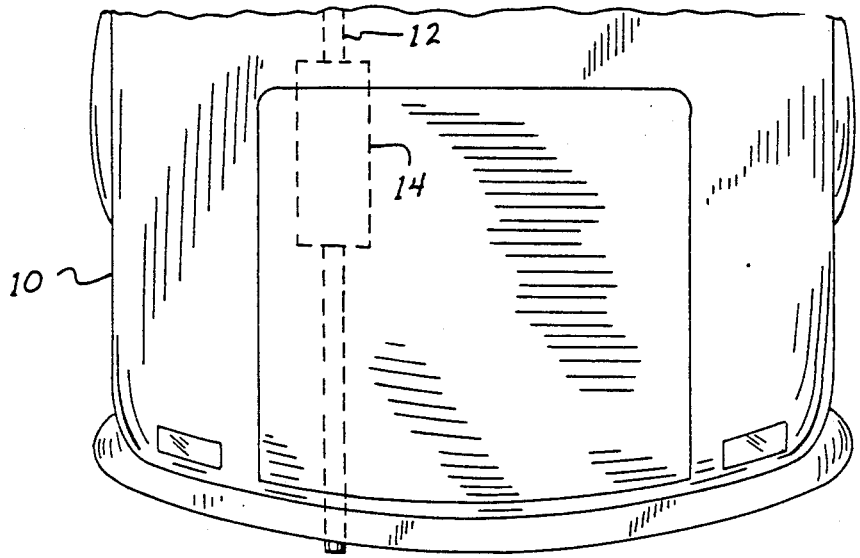
FIG. 1 is a top view of the rear portion of an automobile, with the exhaust pipe and muffler shown in dashed line.

FIG. 1 shows a top view of the rear portion of an automobile 10 having an internal combustion engine (not shown) with an exhaust pipe 12 and muffler 14 shown in dashed line. Mufflers typically include acoustically absorptive or baffling structure for passively attenuating the engine exhaust noise.

Figure 2:
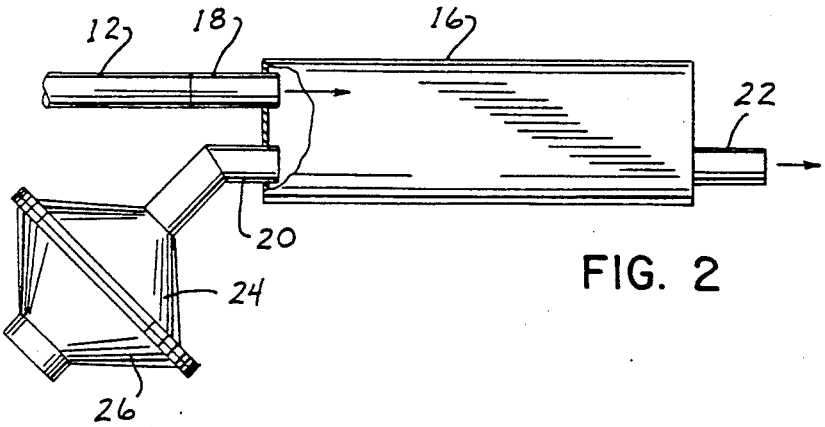
FIG. 2 shows an early attempt of applicant to provide an electronic muffler.

FIG. 2 shows an early attempt of applicant to provide an electronic muffler using active acoustic attenuation. A mixing chamber 16 has a first inlet 18 from exhaust pipe 12, and a second inlet 20 for receiving cancelling sound, and has an outlet 22 for discharging engine exhaust which hopefully has been quieted. Inlet 20 is connected through a funnel-like structure 24 to a cancelling speaker 26. Funnel-like structure 24 was required to couple the larger diametered speaker 26 to the smaller diametered inlet 20. This arrangement was found to be unsatisfactory because of the acoustic loading placed on the speaker due to the reduction in cross sectional area of the flowpath for the cancelling sound before it reached the mixing chamber 16 to mix with the undesirable sound from exhaust pipe 12.

Figure 3:
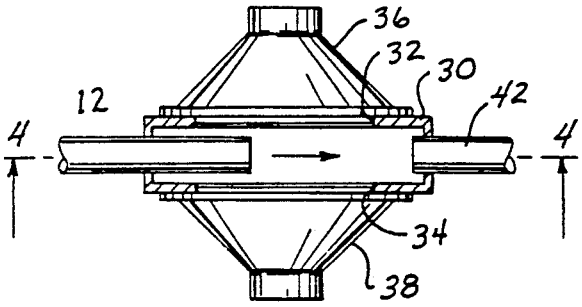
FIG. 3 shows another early attempt of applicant to provide an electronic muffler.
Figure 4:
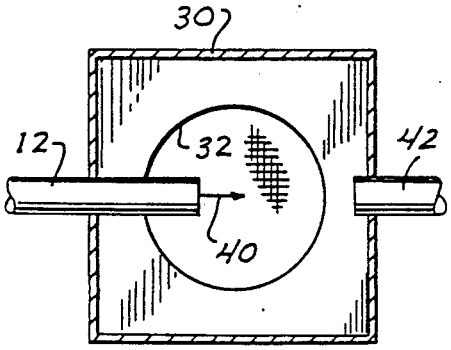
FIG. 4 is a sectional view taken along line 4—4 of FIG. 3.
Figure 5:
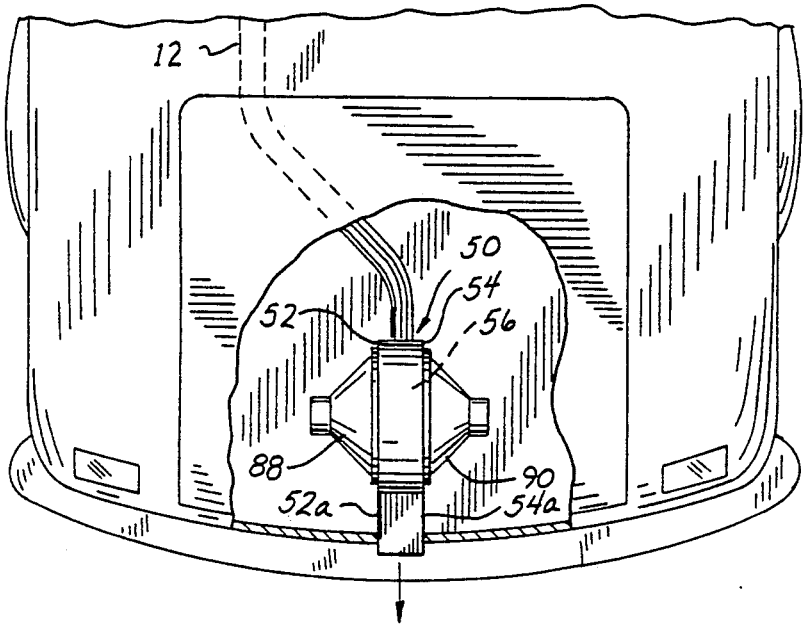
FIG. 5 is a top view of the rear portion of an automobile similar to FIG. 1, but partially cut away and showing the preferred embodiment of active acoustic attenuation apparatus in accordance with the invention.
Figure 6:
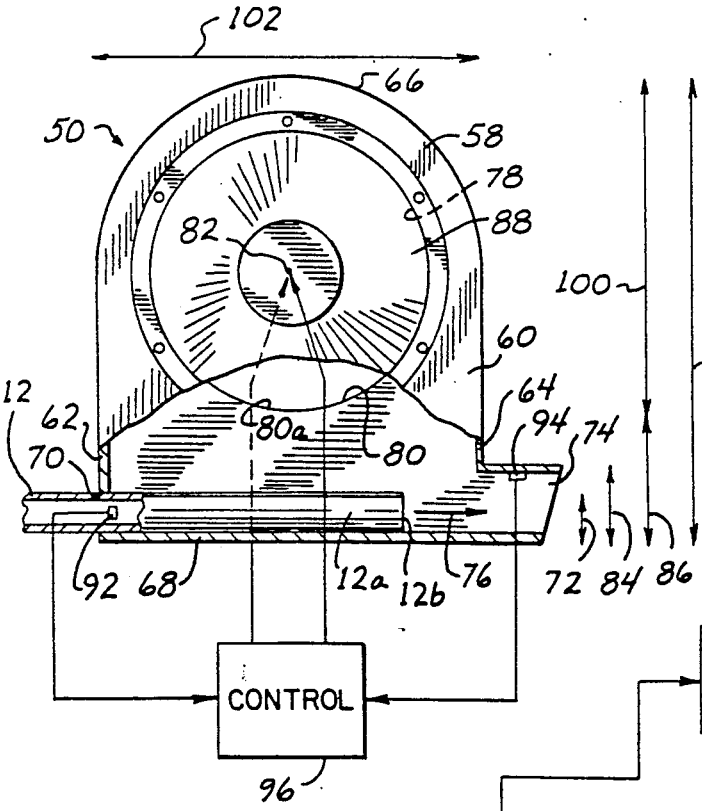
FIG. 6 is a side view of the active acoustic attenuation apparatus of FIG. 5.
Figure 7:
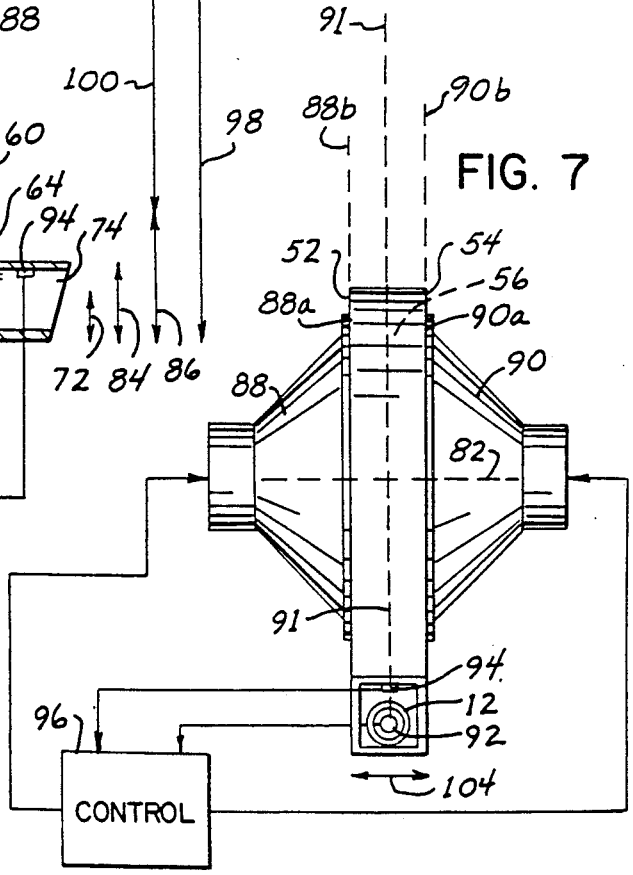
FIG. 7 is an end view of the active acoustic attenuation apparatus of FIG. 5.

FIGS. 3 and 4 show a second attempt by applicant to provide an electronic muffler. A rectangular box-like chamber 30 was provided with openings 32 and 34 in its sidewalls which substantially matched the diameter of respective cancelling acoustic sources, such as speakers 36 and 38. Cancelling sound is thus introduced into the box at a space having an area at least as large as each speaker, to minimize acoustic loading of the speakers. However, it was found that the heat of the hot exhaust along flow path 40 from pipe 12 to outlet 42 was detrimental to the speakers

Preferred Embodiment

FIGS. 5–9 show preferred embodiments of active acoustic attenuation apparatus for cancellation of noise from exhaust pipe 12. A mixing chamber 50 has left and right sidewalls 52 and 54, FIGS. 5 and 7, facing each other across space 56. Each sidewall has an upper generally semi-circular portion as shown at 58 in FIG. 6, and a lower generally rectangular portion as shown at 60. The mixing chamber has a front wall 62, a rear wall 64, a top wall 66, and a bottom wall 68, extending transversely between sidewalls 52 and 54 and enclosing space 56. Front wall 62 has an opening 70 therein at the bottom thereof adjacent bottom wall 68 and providing a chamber input receiving exhaust pipe 12. Input opening 70 has a diameter 72 substantially the same as pipe 12. Rear wall 64 has an opening 74 therein at the bottom thereof adjacent bottom wall 68 and providing a chamber output. Sidewalls 52 and 54 have lower rear extension portions **52*a* and 54*a* extending rearwardly therefrom adjacent bottom wall 68. Exhaust flows along a path 76 through the chamber along bottom wall 68 from opening 70 in front wall 62 at the chamber input to opening 74 in rear wall 64 at the chamber output. Each of sidewalls 52 and 54 has a circular opening 78, 80, respectively, having an axial centerline 82. The upper portion of the circular opening is in the upper semi-circular portion 58 of the sidewall. The lower portion of the circular opening is in the lower generally rectangular portion 60 of the sidewall Opening 70 in front wall 62 and opening 74 in rear-wall 64 define flowpath 76 therebetween which is perpendicular to and offset below centerline 82, and preferably below the bottom of circular openings 78 and 80 in sidewalls 52 and 54. Lower rear extension portions 52*a* and 54*a* have a height 84 greater than or equal to the diameter 72 of exhaust pipe 12 and preferably less than or equal to the height 86 of the bottom 80*a* of each circular opening in each respective sidewall above bottom wall 68. The bottom 80*a* of opening 80 can be below the top of exhaust pipe 12, while still maintaining centerline 82 above the exhaust pipe, though it is preferred that bottom 80*a* of opening 80 be spaced above exhaust pipe 12**.

Speakers 88 and 90 are mounted to the chamber at respective circular openings 78 and 80 in respective sidewalls 52 and 54. Speakers 88 and 90 are directed along axial centerline 82, and introduce sound into chamber 50 in space 56 to cancel undesirable noise in the exhaust from pipe 12. An input microphone 92 senses the input noise in pipe 12, and an output error microphone 94 senses the combined output noise. These signals are fed to a controller 96 which then outputs correction signals to speakers 88 and 90 to control the cancelling sound such that the output sound at microphone 94 is null, or otherwise reduced as desired. It is preferred that controller 96 be provided by the active attenuation systems shown and described in U.S. Pat. Nos. 4,677,676, 4,677,677, 4,736,431, 4,815,139, and 4,837,834, all assigned to the assignee of the present invention, and incorporated herein by reference. It is also preferred that the hybrid active silencing techniques shown and described in U.S. Pat. No. 4,665,549, assigned to the assignee of the present invention, and incorporated herein by reference, be used as appropriate.

Axial loading of the speakers is minimized because they introduce sound into chamber 50 at space 56 having a transverse area at least as large as each speaker. The speaker-mounting sections of the chamber provided at sidewalls 52 and 54 at openings 78 and 80 are transversely offset and spaced from the exhaust flowpath 76, to protect speakers from the heat of the hot exhaust. Speakers 88 and 90 coaxially face each other across space 56. The axial center line 82 of the speakers is laterally offset and spaced from flowpath 76 of the exhaust. Chamber input 70, flowpath 76 and chamber output 74 are all rectilinearly aligned. Mixing chamber 50 thus has an acoustic source mounting section 78 and/or 80 mounting an acoustic source 88 and/or 90 directed along an axial centerline 82 perpendicular to and offset from the flowpath 76. Each acoustic source has a facing surface 88*a*, 90*a* interfacing with chamber 50 at an interface lying in a plane 88*b*, 90*b* parallel to flowpath 76. Axial centerline 82 extends perpendicularly through the respective planes 88*b* and 90*b* and never intersects flowpath 76. The interfaces at 88*a* and 90*a* lie in spaced parallel planes 88*b* and 90*b* parallel to flowpath 76 and define a parallel plane 91 therebetween containing flowpath 76.

Chamber 50 has a height 98 transverse to flowpath 76 and greater than or equal to the height 100 of circular opening 80 in the sidewall. In the preferred embodiment, height 98 is greater than or equal to the sum of the height 72 of exhaust pipe 12 plus the height 100 of circular opening 80 in the sidewall, such that the entire opening 80 is transversely offset and spaced from flowpath 76. Chamber 50 has a length 102 parallel to flowpath 76 and greater than or equal to the length of circular opening 80 in the sidewall. Tube 12*a*, which may be the rear section of exhaust pipe 12 itself or may be a separate connected pipe, is within chamber 50 and extends from chamber input 70 and below centerline 82, and preferably below the bottom 80*a* of circular opening 80 in the sidewall, and has a rear end 12*b* stopping short of chamber output 74.

Chamber 50 has a width 104 transverse to flowpath 76 and substantially comparable to the diameter of exhaust pipe 12 such that chamber 50 is not significantly wider than the exhaust pipe. Speakers 88 and 90 are mounted to the chamber at respective openings 78 and 80 in respective sidewalls 52 and 54 and extend externally from the chamber. Openings 78 and 80 in the sidewalls of the chamber each have a diameter substantially larger than the diameter of exhaust pipe 12. As noted above, the height 98 of chamber 50 is preferably greater than or equal to the sum of the diameter 72 of exhaust pipe 12 plus the diameter 100 of the circular opening in the chamber sidewall. The space 56 into which sound is introduced from the cancelling speakers has a transverse area larger than each speaker.

Figure 8:
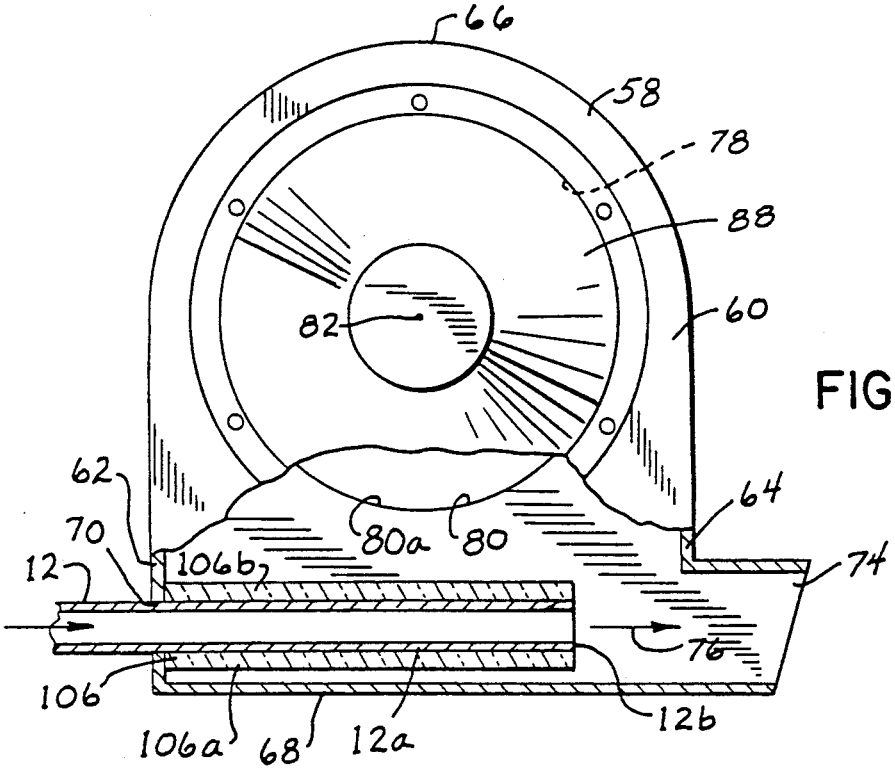
FIG. 8 is a view like FIG. 6 and shows an alternate embodiment.

In FIG. 8, heat insulating material 106 surrounds tube 12*a* within chamber 50. The heat insulating material extends from chamber input 70 along tube 12*a* and has a lower portion 106*a* between tube 12*a* and bottom wall 68, and has an upper portion 106*b* between tube 12*a* and axial centerline 82.

Figure 9:
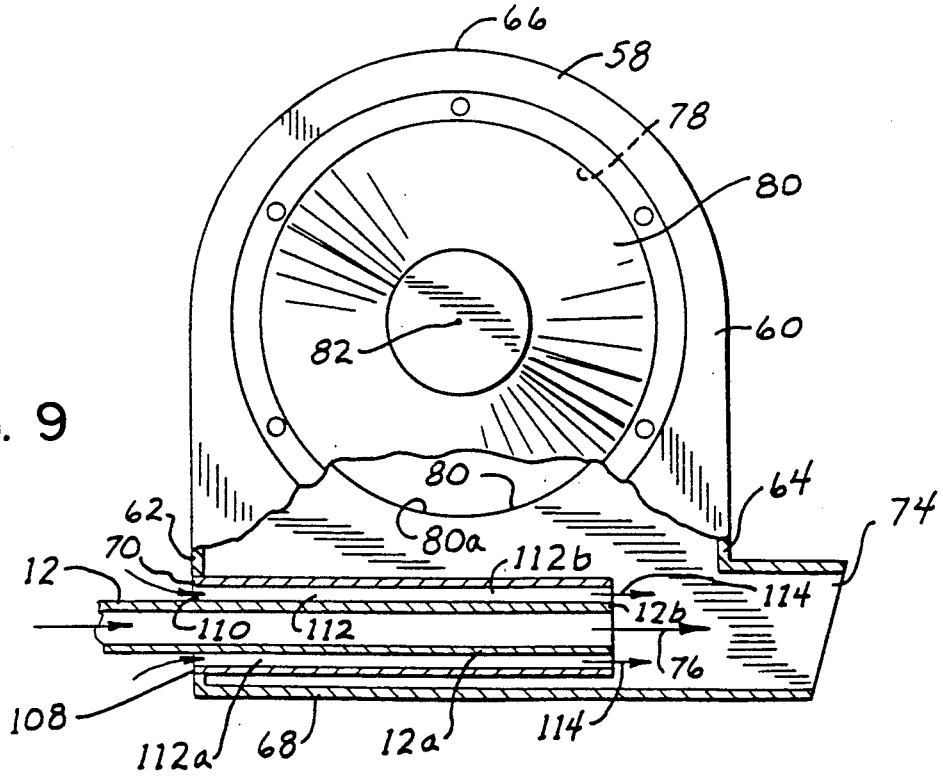
FIG. 9 is a view like FIG. 6 and shows an alternate embodiment.

In FIG. 9, an outer tube 108 is concentric to inner tube 12*a* and extends from chamber input 70 and has an air inlet 110 at chamber input 70 for receiving air into annular space 112 between inner tube 12*a* and outer tube 108 for convective cooling of inner tube 12*a*. Outer tube 108 extends from chamber input 70 along inner tube 12*a* and directs cooling air along inner tube 12*a*. Outer tube 108 stops short of chamber output 74 and directs cooling air as shown at arrows 114 to chamber output 74 substantially parallel to flowpath 76. Inner tube 12*a* and outer tube 108 define the noted annular space 112 therebetween having a lower portion 112*a* between flowpath 76 and bottom wall 68, and an upper portion 112*b* between flowpath 76 and centerline 82.

It is recognized that various equivalents, alternatives and modifications are possible within the scope of the appended claims.

I claim:

1. Active acoustic attenuation apparatus for cancellation of noise from an exhaust pipe, comprising a chamber defined by an enclosing wall structure, said chamber having an input receiving exhaust from said pipe and directing said exhaust along a flowpath to a chamber output, said chamber having a section mounting an acoustic source directed along an axial centerline perpendicular to and offset from said flowpath, said acoustic source introducing sound into said chamber at a space having a transverse area at least as large as said acoustic source, to minimize acoustic loading of said acoustic source, the sound from said acoustic source cancelling undesirable noise in said exhaust.

2. The invention according to claim 1 wherein said acoustic source has a facing surface interfacing with said chamber at an interface lying in a plane parallel to said flowpath, said axial centerline extending perpendicularly through said plane and never intersecting said flowpath.

3. The invention according to claim 2 wherein said chamber input, said flowpath, and said chamber output are all rectilinearly aligned and define a line parallel to said plane.

4. The invention according to claim 1 comprising two acoustic sources coaxially facing each other across said space, the axial centerline of said sources being laterally offset from said flowpath, said acoustic sources having facing surfaces respectively interfacing with said chamber at respective interfaces lying in spaced parallel planes parallel to said flowpath, said axial centerline extending perpendicularly through said planes and never intersecting said flowpath, said spaced parallel planes defining a parallel plane therebetween containing said flowpath.

5. Active acoustic attenuation apparatus for cancellation of noise from an exhaust pipe having a diameter substantially less than a cancelling acoustic source, comprising a chamber defined by an enclosing wall structure, said chamber having an input receiving exhaust from said pipe and directing said exhaust along a flowpath to a chamber output, said chamber having a section comprising an opening in a sidewall of said chamber, and having an axial centerline transversely offset from said flowpath, an acoustic source mounted to said chamber at said opening in said sidewall and extending externally of said chamber and introducing sound into said chamber at a space having an area at least as large as said acoustic source to minimize acoustic loading of said acoustic source, the sound from said acoustic source cancelling undesirable noise in said exhaust, said opening having a height transverse to said flowpath and a length parallel to said flowpath, said chamber having a height transverse to said flowpath and greater than or equal to the height of said opening in said sidewall, said chamber having a length parallel to said flowpath and greater than or equal to the length of said opening in said sidewall.

6. The invention according to claim 5 comprising a tube within said chamber and extending from said chamber input below said axial centerline and stopping short of said chamber output, said exhaust flowing along said flowpath through said tube.

7. The invention according to claim 6 wherein said tube comprises a section of said exhaust pipe extending into said chamber.

8. The invention according to claim 5 wherein said opening in said sidewall of said chamber is transversely offset and spaced from said flowpath, and wherein said exhaust pipe has a height transverse to said flowpath, and said height of said chamber transverse to said flowpath is greater than or equal to the height of said exhaust pipe plus said height of said opening in said sidewall.

9. The invention according to claim 8 wherein said tube extends below a bottom of said opening in said sidewall.

10. Active acoustic attenuation apparatus for cancellation of noise from an exhaust pipe of a given diameter, comprising a chamber defined by an enclosing wall structure, said chamber having an input opening of said given diameter and receiving said pipe and the exhaust therefrom and directing the exhaust along a flowpath to a chamber output, said chamber having a section transversely offset from said flowpath, said chamber having a width transverse to said flowpath and substantially comparable to said given diameter such that said chamber is not significantly wider than said exhaust pipe, an acoustic source mounted to said chamber at said section and introducing sound into said chamber to cancel undesirable noise in said exhaust, said acoustic source having a height transverse to said flowpath and a length parallel to said flowpath, said chamber having a height transverse to said flowpath and greater than or equal to the height of said acoustic source, said chamber having a length parallel to said flowpath and greater than or equal to the length of said acoustic source.

11. The invention according to claim 10 wherein said acoustic source introduces sound into said chamber at a space having a transverse area at least as large as said acoustic source, to minimize acoustic loading of said acoustic source.

12. The invention according to claim 11 wherein said acoustic source is mounted to said chamber at an opening in a sidewall of said chamber, said acoustic source extending externally from said chamber, said opening in said sidewall having a diameter substantially larger than the diameter of said exhaust pipe.

13. The invention according to claim 12 wherein said acoustic source is directed along an axial centerline perpendicular to and offset from said flowpath, said acoustic source having a facing surface interfacing with said chamber at said opening in said sidewall at an interface lying in a plane parallel to said flowpath, said axial centerline extending perpendicularly through said plane and never intersecting said flowpath.

14. The invention according to claim 13 wherein said chamber input, said flowpath, and said chamber output are all rectilinearly aligned and define a line parallel to said plane.

15. The invention according to claim 12 comprising two acoustic sources coaxially facing each other, a axial centerline of said acoustic sources being laterally offset from said flowpath of said exhaust, said acoustic sources having respective facing surfaces interfacing with said chamber at respective interfaces lying in spaced parallel planes parallel to said flowpath, said axial centerline extending perpendicularly through said planes and never intersecting said flowpath, said spaced parallel planes defining a parallel plane therebetween containing said flowpath.

16. The invention according to claim 12 wherein said chamber has a height transverse to said flowpath and a length parallel to said flowpath, and wherein the height of said chamber is greater than or equal to the diameter of said exhaust pipe plus the diameter of said opening in said sidewall such that the space in said chamber into which sound is introduced from said acoustic source has a transverse area larger than said acoustic source, and wherein the length of said chamber is greater than or equal to the diameter of said opening in said sidewall.

17. The invention according to claim 10 wherein said exhaust pipe includes a section extending into said chamber and laterally offset from said acoustic source and terminating at a point spaced from said chamber output.

18. Active acoustic attenuation apparatus for cancellation of noise from an exhaust pipe, comprising a chamber defined by an enclosing wall structure, said chamber having an input receiving exhaust from said exhaust pipe and directing said exhaust along a flowpath to a chamber output, said chamber having a section transversely offset from said flowpath, an acoustic source mounted to said chamber at said section and having an axial centerline transversely offset from said flowpath and introducing sound into said chamber at a space having a transverse area at least as large as said acoustic source, to minimize acoustic loading to said acoustic source, the sound from said acoustic source cancelling undesirable noise in said exhaust, a tube within said chamber and extending from said chamber input below said axial centerline and stopping short of said chamber output, heat insulating material surrounding said tube within said chamber, said exhaust flowing along said flowpath through said tube.

19. The invention according to claim 18 wherein said tube comprises a section of said exhaust pipe extending into said chamber, and wherein said chamber has left and right sidewalls facing each other across said space, said chamber has front, rear, top and bottom walls extending transversely between said sidewalls and enclosing said space, said front wall has a bottom, said front wall has an opening therein at the bottom thereof adjacent said bottom wall and providing a chamber input receiving said exhaust pipe, said rear wall has a bottom, said rear wall has an opening therein at the bottom thereof adjacent said bottom wall and providing a chamber output, such that exhaust flows along a path through said chamber along said bottom wall from said opening in said front wall at said chamber input to said opening in said rear wall at said chamber output, said heat insulating material extends from said chamber input along said tube and has a lower portion between said tube and said bottom wall, and has an upper portion between said tube and said axial centerline.

20. Active acoustic attenuation apparatus for cancellation of noise from an exhaust pipe, comprising a chamber defined by an enclosing wall structure, said chamber having an input receiving exhaust from said exhaust pipe and directing said exhaust along a flowpath to a chamber output, said chamber having a section transversely offset from said flowpath, an acoustic source mounted to said chamber at said section and having an axial centerline transversely offset from said flowpath, and introducing sound into said chamber at a space having a transverse area at least as large as said acoustic source, to minimize acoustic loading of said acoustic source, the sound from said acoustic source cancelling undesirable noise in said exhaust, an inner tube within said chamber and extending from said chamber input below said axial centerline and stopping short of said chamber output, said exhaust flowing along said flowpath through said inner tube, an outer tube concentric to said inner tube and defining a space between said inner tube and said outer tube and extending from said chamber input and having an air inlet at said chamber input for receiving air into the space between said inner and outer tubes for convective cooling of said inner tube.

21. The invention according to claim 20 wherein said outer tube extends from said chamber input along said inner tube and directs cooling air along said inner tube.

22. The invention according to claim 21 wherein said outer tube stops short to said chamber output and directs said cooling air to said chamber output substantially parallel to said flowpath of said exhaust through said inner tube.

23. The invention according to claim 22 wherein said chamber has left and right sidewalls facing each other across said space, said chamber has front, rear, top and bottom walls extending transversely between said sidewalls and enclosing said space, said front wall has a bottom, said front wall has an opening therein at the bottom thereof adjacent said bottom wall and providing said chamber input receiving said exhaust pipe and from which said inner tube and said outer tube extend within said chamber, said rear wall has a bottom, said rear wall has an opening therein at the bottom thereof adjacent said bottom wall and providing said chamber output, such that exhaust flows along a path through said chamber along said bottom wall from said opening in said front wall at said chamber input to said opening in said rear wall at said chamber output, said inner and outer tubes defining an annular space therebetween having a lower portion between said flowpath and said bottom wall, and an upper portion between said flowpath and said centerline.

24. Active acoustic attenuation apparatus for cancellation of noise from an exhaust pipe, comprising a mixing chamber having left and right sidewalls facing each other across a space, each sidewall having an upper generally semicircular portion and a lower generally rectangular portion, said mixing chamber having front, rear, top and bottom walls extending transversely between said sidewalls and enclosing said space, said front wall having a bottom, said front wall having an opening therein at the bottom thereof adjacent said bottom wall and providing a chamber input receiving said exhaust pipe, said rear wall having a bottom, said rear wall having an opening therein at the bottom thereof adjacent said bottom wall and providing a chamber output, such that exhaust flows along a path through said chamber along said bottom wall from said opening in said front wall at said chamber input to said opening in said rear wall at said chamber output, at least one of said sidewalls of said chamber having a circular opening therein, said circular opening having an upper portion and a lower portion, the upper portion of said circular opening being in said upper semicircular portion of said sidewall, the lower portion of said circular opening being in the lower generally rectangular portion of said sidewall, said opening in said front wall and said opening in said rear wall defining a flowpath therebetween, said circular opening having an axial centerline transversely offset from said flowpath, said flowpath being below the axial centerline of said circular opening in said sidewall, an acoustic source mounted to said chamber at said circular opening in said sidewall and introducing sound into said chamber in said space to cancel undesirable noise in said exhaust.

25. The invention according to claim 24 wherein both of said sidewalls have circular openings therein, and comprising two acoustic sources each mounted to said chamber at a respective said opening and coaxially facing each other across said space and having an axial centerline laterally offset and spaced from said flowpath of said exhaust between said opening in said front wall and said opening in said rear wall.

26. The invention according to claim 24 wherein said exhaust pipe has a diameter, said circular opening in said sidewall has a bottom, the bottom of said circular opening is spaced above said bottom wall by a given height, said sidewalls have lower rear extension portions extending rearwardly therefrom adjacent said bottom wall and having a height greater than or equal to the diameter of said exhaust pipe and less than or equal to said given height of the bottom of said circular opening in said sidewall above said bottom wall.

27. The invention according to claim 24 comprising a tube within said chamber and extending from said chamber input below said axial centerline and stopping short of said chamber output, heat insulating material surrounding said tube within said chamber, said exhaust flowing along said flowpath through said tube.

28. The invention according to claim 24 comprising an inner tube within said chamber and extending from said chamber input below said axial centerline and stopping short of said chamber output, said exhaust flowing along said flowpath through said inner tube, an outer tube concentric to said inner tube and defining a space between said inner tube and said outer tube and extending from said chamber input and having an air inlet at said chamber input for receiving air into the space between said inner and outer tubes for convective cooling of said inner tube.

29. Active acoustic attenuation apparatus for cancellation of noise from a hot exhaust pipe, including the exhaust pipe of a motor vehicle, comprising a chamber defined by an enclosing wall structure, said chamber having an input receiving hot exhaust from said hot exhaust pipe and directing said hot exhaust along a flowpath to a chamber output, said chamber having a section mounting an acoustic source directed along an axial centerline transversely spaced and offset from said flowpath, to protect said acoustic source from said hot exhaust, and introducing sound into said chamber at a space having a transverse area at least as large as said acoustic source, to minimize acoustic loading of said acoustic source, the sound from said acoustic source cancelling undesirable noise in said hot exhaust.

30. The invention according to claim 29 comprising a tube within said chamber extending from said chamber inlet below said acoustic source and stopping short of said chamber output, said hot exhaust flowing along said flowpath through said tube and spaced from said acoustic source.

31. The invention according to claim 29 wherein said hot exhaust pipe has a diameter substantially less than said acoustic source.

32. The invention according to claim 31 wherein said chamber has a width transverse to said flowpath and substantially comparable to said diameter of said hot exhaust pipe.

33. The invention according to claim 32 wherein said acoustic source is mounted to said chamber at an opening in a sidewall of said chamber, said acoustic source extending externally from said chamber, said opening in said sidewall having a diameter substantially larger than said diameter of said hot exhaust pipe.

34. The invention according to claim 33 wherein said chamber has a height transverse to said flowpath and a length parallel to said flowpath, and wherein the height of said chamber is greater than or equal to said diameter of said hot exhaust pipe plus said diameter of said opening in said sidewall, and wherein the length of said chamber is greater than or equal to said diameter of said opening in said sidewall.

* * * * *